US008439765B2

(12) United States Patent
Barron et al.

(10) Patent No.: US 8,439,765 B2
(45) Date of Patent: May 14, 2013

(54) CHILD SWING AND JUMPER APPARATUS AND METHODS OF OPERATING THE SAME

(75) Inventors: Traci Barron, St. John, IN (US); Ross Carl, River Forest, IL (US); Paul J. Corsi, Terryville, CT (US); Douglas Melville, Jr., Simsbury, CT (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

(21) Appl. No.: 13/284,118

(22) Filed: Oct. 28, 2011

(65) Prior Publication Data

US 2012/0084960 A1 Apr. 12, 2012

Related U.S. Application Data

(63) Continuation of application No. 12/044,588, filed on Mar. 7, 2008, now Pat. No. 8,070,617.

(60) Provisional application No. 60/894,530, filed on Mar. 13, 2007.

(51) Int. Cl.
*A63G 9/12* (2006.01)
*A63G 9/04* (2006.01)

(52) U.S. Cl.
USPC ..... 472/118; 472/119

(58) Field of Classification Search ..... 472/118–125, 472/135; 482/69, 77, 78; 297/273, 274
See application file for complete search history.

(56) References Cited

U.S. PATENT DOCUMENTS

| | | | |
|---|---|---|---|
| 342,855 | A | 6/1886 | Abbey et al. |
| 1,406,650 | A | 2/1922 | Jones |
| 2,023,235 | A | 12/1935 | Count |
| 2,697,477 | A | 12/1954 | Welsh |
| 3,146,985 | A | 9/1964 | Grudoski |
| 3,186,711 | A | 6/1965 | Morrow |
| 3,271,029 | A | 9/1966 | Grudoski |
| 3,759,539 | A | 9/1973 | Goldberg |
| 3,765,674 | A | 10/1973 | Siler |
| 4,022,510 | A | 5/1977 | Saint |
| 4,057,235 | A | 11/1977 | Halopoff |
| 4,138,104 | A | 2/1979 | D'Amicis |
| 4,150,820 | A | 4/1979 | Bochmann |
| 4,165,872 | A | 8/1979 | Saint |
| D254,409 | S | 3/1980 | Borucki |
| 4,211,401 | A | 7/1980 | Cunard |
| 4,323,233 | A | 4/1982 | Gebhard |
| 4,324,432 | A | 4/1982 | Eldon, III et al. |
| 4,325,578 | A | 4/1982 | Borucki |

(Continued)

OTHER PUBLICATIONS

United Stated Patent and Trademark Office, "Notice of Allowance," issued in connection with U.S. Appl. No. 12/044,588, mailed Jul. 29, 2011, 12 pages.

(Continued)

*Primary Examiner* — Kien Nguyen
(74) *Attorney, Agent, or Firm* — Hanley, Flight & Zimmerman, LLC

(57) ABSTRACT

Child entertainment apparatus and methods of operating the same are disclosed. An example method of operating a child entertainment apparatus includes suspending a seat from a frame and driving the seat for swinging movement by reciprocating an arm slidably coupled to the seat where the seat is free to slide along the arm when the seat swings.

20 Claims, 15 Drawing Sheets

U.S. PATENT DOCUMENTS 4,452,446 A 6/1984 Saint
4,491,317 A 1/1985 Bansal
4,616,824 A 10/1986 Quinlan, Jr. et al.
4,688,850 A 8/1987 Brownlie et al.
D293,046 S 12/1987 Riehm
4,722,521 A 2/1988 Hyde et al.
4,785,678 A 11/1988 McGugan et al.
4,805,902 A 2/1989 Casagrande
4,822,033 A 4/1989 Kohus et al.
5,083,773 A 1/1992 Saint
5,342,245 A 8/1994 Webb, Jr.
5,378,196 A 1/1995 Pinch et al.
D368,816 S 4/1996 Mitchell et al.
5,525,113 A 6/1996 Mitchell et al.
5,533,936 A 7/1996 Julien et al.
5,624,321 A 4/1997 Snyder
5,628,689 A 5/1997 Saint et al.
5,704,882 A 1/1998 Coates et al.
D392,126 S 3/1998 Sack
5,769,727 A 6/1998 Fair et al.
5,788,014 A 8/1998 Saint et al.
5,803,817 A 9/1998 Stern
5,816,983 A 10/1998 Dawes et al.
5,833,545 A 11/1998 Pinch et al.
5,846,136 A 12/1998 Wu
5,848,553 A 12/1998 Miyazaki
5,855,140 A 1/1999 Imamura
5,857,944 A 1/1999 Cone et al.
5,876,311 A 3/1999 Coates et al.
D412,067 S 7/1999 Wu
5,975,631 A 11/1999 Fair et al.
5,996,192 A 12/1999 Haines et al.
6,010,410 A 1/2000 Lauro et al.
6,022,277 A 2/2000 Jankowski
6,027,409 A 2/2000 Favorito et al.
6,059,667 A 5/2000 Pinch
D428,268 S 7/2000 Fair
6,098,970 A 8/2000 Lowe
6,120,418 A 9/2000 Plough
6,193,224 B1 2/2001 Dillner et al.
6,260,833 B1 7/2001 Drager
6,273,505 B1 8/2001 Carnahan
6,283,870 B1 9/2001 Saint et al.
6,319,138 B1 11/2001 Fair et al.
6,339,304 B1 1/2002 Allison et al.
6,361,446 B2 3/2002 Lawson et al.
D456,189 S 4/2002 Flannery et al.
6,386,901 B1 5/2002 Caldwell
6,386,986 B1 5/2002 Sonner et al.
6,421,901 B2 7/2002 Sitarski et al.
6,428,098 B1 8/2002 Allbaugh
6,464,594 B1 10/2002 Canna et al.
6,471,597 B1 10/2002 Flannery et al.
6,500,072 B1 12/2002 Myers et al.
6,511,123 B1 1/2003 Sitarski et al.
6,520,862 B1 2/2003 Armbruster et al.
6,544,128 B1 4/2003 Yang
6,561,915 B2 5/2003 Kelly et al.
6,626,766 B1 9/2003 Hsia
6,645,080 B1 11/2003 Greger et al.
6,648,411 B2 11/2003 Julien
6,666,473 B2 12/2003 Hartenstine et al.
6,666,505 B2 12/2003 Greger et al.
6,669,225 B2 12/2003 Greger et al.
D485,690 S 1/2004 Hsia
D486,965 S 2/2004 Hsia
6,692,368 B1 2/2004 Hyun
6,702,685 B2 3/2004 Mahlstedt et al.
6,705,950 B2 3/2004 Wood et al.
D490,993 S 6/2004 Longenecker et al.
6,824,472 B2 11/2004 Armbruster et al.
6,824,473 B2 11/2004 Wu
6,830,517 B1 12/2004 Ciraolo
6,857,700 B2 2/2005 Eastman et al.
6,857,966 B2 2/2005 Armbruster et al.
D503,055 S 3/2005 Longenecker et al.
6,872,146 B1 3/2005 Paesang et al.
6,875,117 B2 4/2005 Ransil et al.
6,877,802 B2 4/2005 Christensen et al.
D504,791 S 5/2005 Longenecker et al.
6,887,161 B2 5/2005 Mahlstedt et al.
6,896,624 B2 5/2005 Longenecker et al.
6,902,489 B2 6/2005 Greger et al.
6,908,397 B2 6/2005 Armbruster et al.
6,916,249 B2 7/2005 Meade
6,926,359 B2 8/2005 Runk
6,932,426 B2 8/2005 Greger
6,932,709 B1 8/2005 Gubitosi et al.
6,994,630 B2 2/2006 Paesang
7,052,403 B2 5/2006 Ransil et al.
7,066,536 B2 6/2006 Williams et al.
7,081,052 B2 7/2006 Greger et al.
7,326,120 B2 2/2008 Bellows et al.
7,607,734 B2 10/2009 Clapper et al.
7,727,076 B2 * 6/2010 Bapst et al. ..... 472/103
7,770,971 B2 8/2010 Bellows et al.
7,824,273 B2 11/2010 Clapper et al.
7,878,915 B2 2/2011 Myers et al.
7,883,426 B2 2/2011 Bellows et al.
8,357,054 B2 1/2013 Myers et al.
2003/0067193 A1 4/2003 Asbach et al.
2003/0199329 A1 10/2003 Wood et al.
2004/0102252 A1 5/2004 Longenecker et al.
2004/0102253 A1 5/2004 Ransil et al.
2004/0198511 A1 10/2004 Greger et al.
2004/0198512 A1 10/2004 Ransil et al.
2004/0198513 A1 10/2004 Wood et al.
2004/0198515 A1 10/2004 Wood et al.
2004/0239163 A1 12/2004 Runk et al.
2004/0259647 A1 12/2004 Wood et al.
2005/0014569 A1 1/2005 Greger et al.
2005/0059502 A1 3/2005 Greger et al.
2005/0125970 A1 6/2005 Nolan
2005/0127727 A1 6/2005 Gangadharan et al.
2005/0225157 A1 10/2005 Patrizi et al.
2005/0239565 A1 10/2005 Ransil et al.
2006/0096153 A1 5/2006 Jung
2006/0194639 A1 8/2006 Greger et al.
2006/0214486 A1 9/2006 Ransil et al.
2006/0252564 A1 11/2006 Bellows et al.
2007/0111809 A1 5/2007 Bellows et al.
2007/0267904 A1 11/2007 Clapper et al.
2008/0217974 A1 9/2008 Velderman et al.
2009/0033133 A1 2/2009 Barron et al.
2009/0170618 A1 7/2009 Bellows et al.
2009/0181780 A1 7/2009 Myers et al.
2010/0201171 A1 8/2010 Velderman et al.

OTHER PUBLICATIONS

United States Patent and Trademark Office, "Notice of Allowance," issued in connection with U.S. Appl. No. 12/044,588, mailed Mar. 18, 2011, 11 pages.

United States Patent and Trademark Office, "Non-Final Office Action," issued in connection with U.S. Appl. No. 12/044,588, mailed Jul. 30, 2010, 24 pages.

The State Intellectual Property Office of China, "First Office Action," issued in connection with Chinese application serial No. 200680007334.5, issued May 8, 2009, 6 pages.

The State Intellectual Property Office of China, "Second Office Action," issued in connection with Chinese application serial No. 200680007334.5, issued Aug. 30, 2010, 7 pages.

United States Patent and Trademark Office, "Restriction Requirement," issued in connection with U.S. Appl. No. 11/885,733, mailed Oct. 1, 2010, 6 pages.

United States Patent and Trademark Office, "Notice of Allowance," issued in connection with U.S. Appl. No. 11/885,733, mailed Dec. 16, 2010, 30 pages.

International Bureau, "International Preliminary Report on Patentability," issued in connection with international application serial No. PCT/US06/08070, mailed Jul. 2, 2007, 7 pages.
International Searching Authority, "International Search Report," issued in connection with international application serial No. PCT/US06/08070, mailed Sep. 25, 2006, 3 pages.
International Searching Authority, "Written Opinion of the International Searching Authority," issued in connection with international application serial No. PCT/US06/08070, mailed Sep. 25, 2006, 5 pages.
United States Patent and Trademark Office, "Supplemental Notice of Allowance," issued in connection with U.S. Appl. No. 12/977,470, mailed Dec. 19, 2012, 3 pages.

United States Patent and Trademark Office, "Issue Notification," issued in connection with U.S. Appl. No. 12/977,470, mailed Dec. 29, 2012, 1 page.

* cited by examiner

CHILD SWING AND JUMPER APPARATUS AND METHODS OF OPERATING THE SAME

CROSS REFERENCE TO RELATED APPLICATION

This patent arises from a continuation of U.S. application Ser. No. 12/044,588, filed Mar. 7, 2008, which claims the benefit of U.S. Provisional Patent Application No. 60/894,530, filed on Mar. 13, 2007, both of which are hereby incorporated by reference in their entireties.

FIELD OF THE DISCLOSURE

This disclosure relates generally to child care products, and, more particularly, to child swing and jumper apparatus and methods of operating the same.

BACKGROUND OF RELATED ART

Infant swings of various types are known. One type of infant swing is an open top swing which, as its name suggests, does not include a bar or housing member above and across the seat. This opening above the seat facilitates inserting/removing an infant to/from the swing. Open top swings generally include a base or frame member which is disposed on the ground surface. A swing assembly is connected to and depends from the frame. The swing assembly is adapted to pivot relative to the frame assembly. The desired swinging movement is generated either manually or by a drive motor.

Infant jumpers of various types are also known. Some jumpers include a seat and spring supports for suspending the seat from a door frame or the like. A small child located in the seat can obtain exercise and entertainment by moving to cause the jumper to bounce within the door frame.

Bouncers which are constructed as reclined seats or bassinets are also known. These bouncers include a frame that positions the seat in a reclined position. The frame, which may be constructed of wire, experiences damped oscillatory movements when the child moves or when a care provider intentionally bounces the frame. Sometimes a mechanical vibrator is coupled to the frame to provide vibrations that can soothe or entertain an infant located in the bouncer.

In recent years, walker alternatives have been developed. Walker alternatives (sometimes referred to as bouncers, activity centers or child entertaining apparatus) generally include a base and a seat/sling that is suspended from a tray above the base. The tray is typically spaced a sufficient distance above the base such that the feet of a child seated in the seat/sling can reach the base to simulate standing. In some known walker alternatives, the tray is suspended above the base using adjustable columns to permit adjustment of the distance between the tray and the base to fit the height of the child.

The seats/slings of the known walker alternatives are typically rotatably suspended in the center of their trays such that the seats/slings are surrounded on all sides by their corresponding trays. Toys can be placed at various positions on the tray to encourage a child suspended in the seat/sling to use his/her legs to rotate themselves to reach the toys of interest. The bases of some known walker alternatives are cupped or bowled (e.g., semi-spherical) to permit rocking of the walker alternative. Some walker alternatives also suspend their trays, and, thus, their seats, using springs to permit bouncing of the tray, seat and/or child.

DETAILED DESCRIPTION

Figure 1:
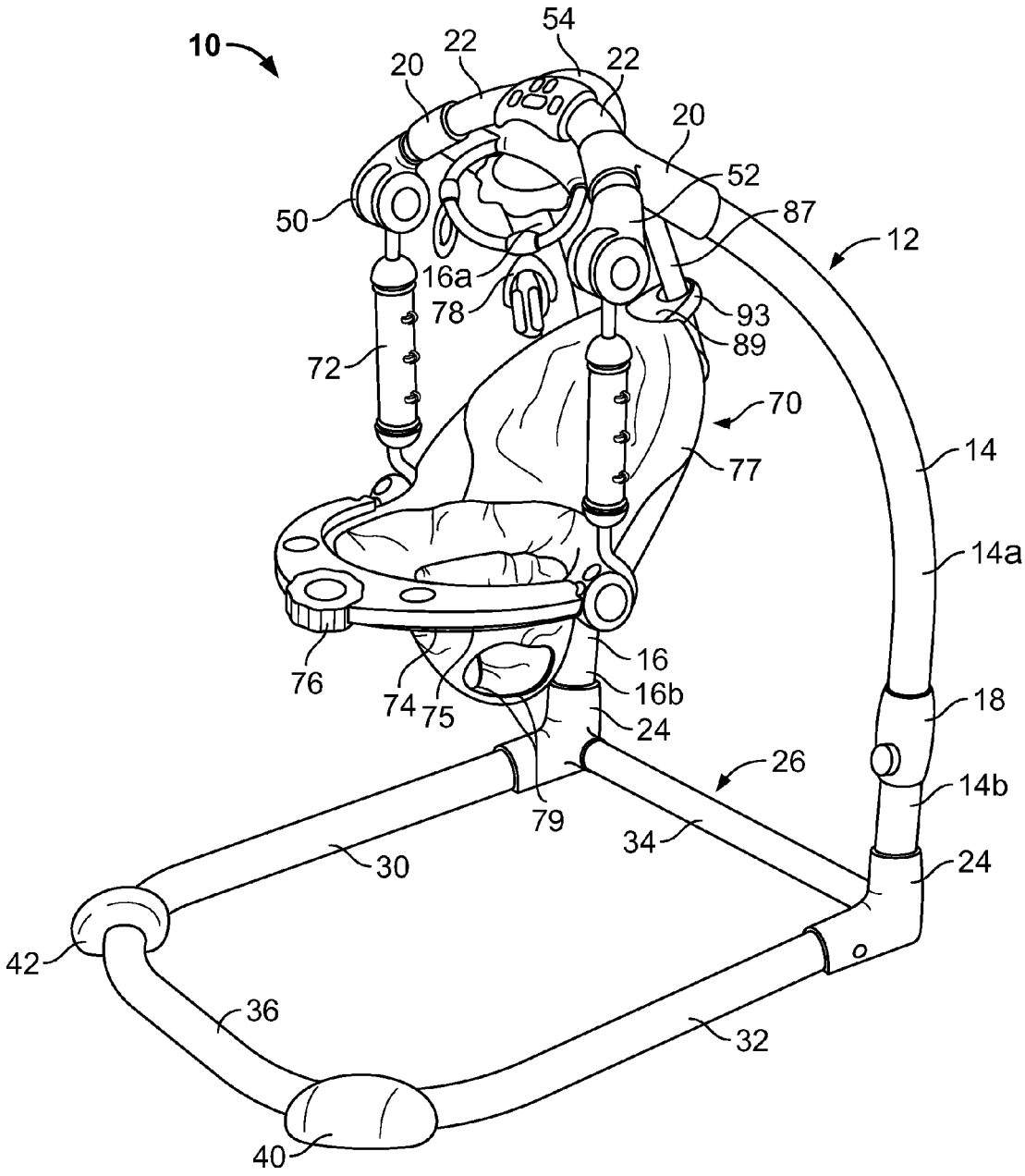
FIG. 1 is a perspective view of an example child swing and jumper apparatus constructed in accordance with the teachings of the present disclosure and showing the apparatus in a swing mode.
Figure 3:
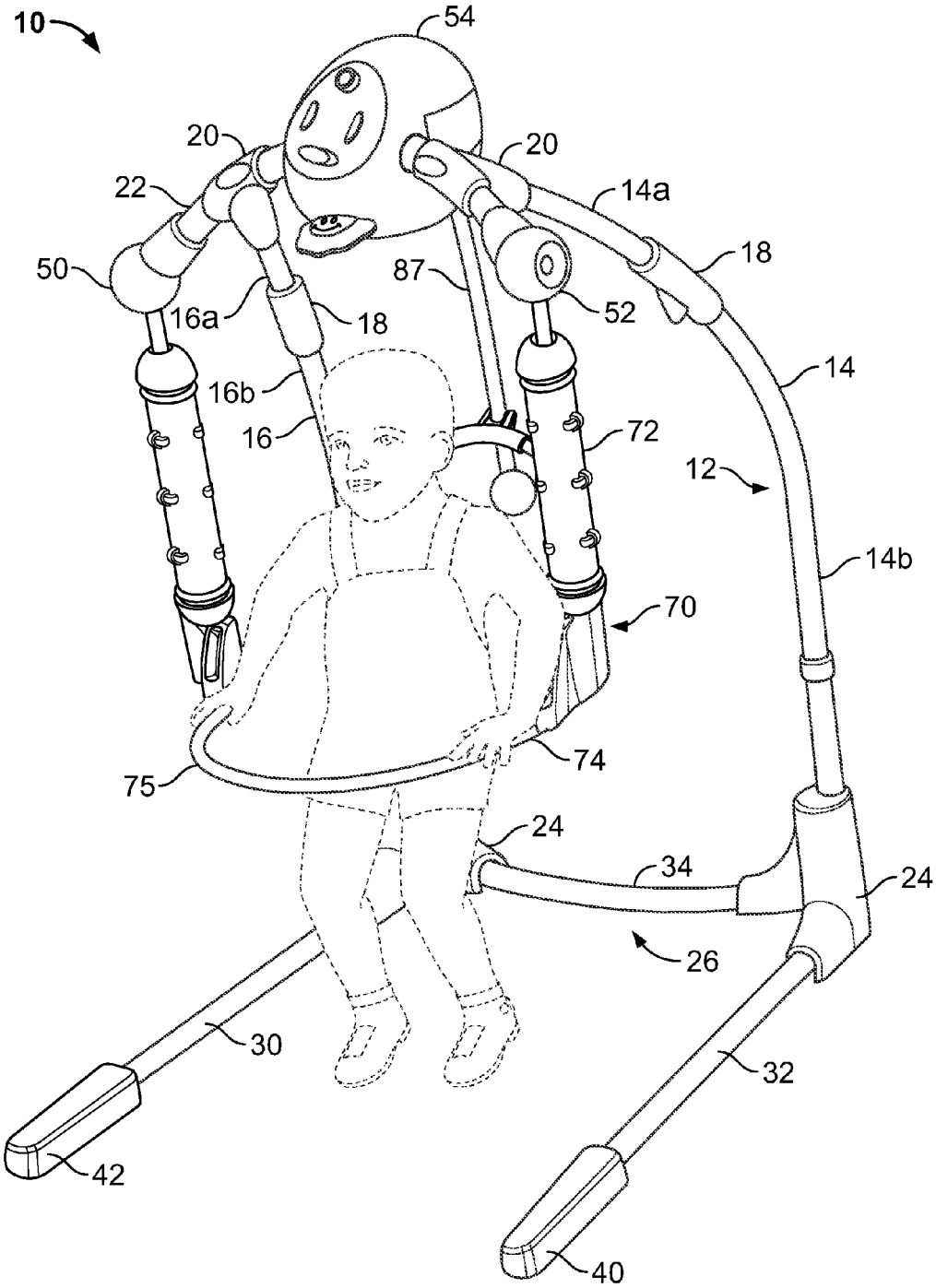
FIG. 3 is a perspective schematic view of another example child swing and jumper apparatus constructed in accordance with the teachings of the present disclosure and showing the apparatus in a jumper mode.

FIGS. 1 and 3 are perspective views of two alternative example child swing and jumper apparatus 10 constructed in accordance with the teachings of the present disclosure. The apparatus 10 of the illustrated examples have two modes of operation. In a first mode (FIG. 1), the apparatus 10 is operable as an infant swing. In a second mode (FIG. 3), the apparatus 10 is operable as a jumper. In some examples, the only difference between these modes is the power state of a drive motor as the child is permitted to swing and bounce in either the swing mode or the jumper mode.

Referring to FIGS. 1-6, in the illustrated examples, the apparatus 10 is provided with a free standing frame 12. The frame 12 of the illustrated example comprises plastic or metal tubular frame legs 14, 16. The tubular frame legs 14, 16, may be adjustable in length to change the overall height of the apparatus 10 by slidably and/or adjustably coupling an upper portion of the frame legs 14*a*, 16*a* to a respective lower portion of the frame legs 14*b*, 16*b*, through a height adjustment mechanism 18. Alternatively, the height of the apparatus 10 may be adjusted by changing the height and/or length of any other portion of the apparatus 10, including, for example, the swing arms, the seat, the frame, etc.

An upper end of each of the frame legs 14, 16 is fastened to one end of a respective connector 20. The connectors 20 support a cross bar 22. The bottom end of each leg 14, 16 is fastened to one end of a respective connector 24. Each connector 24 is fastened to a base support 26. In the illustrated examples, the base support 26 includes two side base support members 30, 32, and at least one base cross support member 34, 36. For instance, the example apparatus of FIGS. 1-2 includes a rear base cross support member 34 and a front base cross support member 36, while the example apparatus of FIG. 3-6 only includes the rear base cross support member 34. However, both examples include the side members 30, 32. In the illustrated examples, the rear base cross support member 34 is connected to and between the connectors 24, while the front base cross support member 36 (if present) is connected to and between the front ends of the side base support members 30, 32. In the illustrated examples, the side support members 30, 32 include base connectors 40, 42. Each of the connectors 24, 40, 42, and/or the base support members 30, 32, 34, 36 are adapted to seat on the ground surface to support and stabilize the apparatus 10.

Any or all of the legs 14, 16, the connectors 24, 40, 42, and/or the base support members 30, 32, 34, 36 may be manufactured in multiple connectable parts and/or of a single unitary structure. Moreover, the location, size, length, and/or configuration of any or all of the legs 14, 16, the connectors 24, 40, 42, and/or the base support members 30, 32, 34, 36 may be varied as desired, and may in some examples, be eliminated completely. Still further, each connector 24, 40, 42 may be joined to its respective leg 14, 16 and base support members 30, 32, 34, 36 in any desired manner (e.g., clipped, snapped to, riveted to, welded, glued, etc.).

As described above, the frame legs 14, 16 converge at their respective top leg ends and are mounted to and/or in the connectors 20. In the illustrated examples, the frame legs 14, 16 extend upward from each of the connectors 24 and are generally inclined toward the center of the base support 26 so that top ends of the frame legs 14, 16, when viewed from the top (FIG. 4), are located generally between the front and rear connectors 24, 40, 42, with the cross bar 22 extended between, and in these examples, beyond the connectors 20.

Each end portion of the cross bar 22 supports a respective pivot housing 50, 52. The cross bar 22 also supports a motor housing 54. The motor housing 54 is generally centrally located along the cross bar 22. The motor housing 54 serves to house a swing motor 90 (see FIG. 11) which, as described below, when actuated, drives a seat assembly through a swinging motion such as, for example, a generally arcuate motion, or a generally linear motion such as a generally horizontal plane. If desired, the swing motor 90 can be incorporated into or can be external of the housing 54. Further, the swing motor 90 can be powered by batteries or commercial alternating current (e.g., household AC). Alternatively, the motion can be applied by a wind-up spring mechanism (not shown). Still further, the apparatus 10 may not include any swing drive mechanism, but instead may be limited to manual swinging and/or bouncing.

In the illustrated example, a convertible swing and jumper assembly 70 is pivotably suspended from the housings 50, 52. The assembly 70 of the illustrated example includes two swing arms 72 and a seat 74. Each of the arms has a top pivotably mounted to a respective one of the housings 50, 52. Although the illustrated example includes two arms 72, other number or arms (e.g., 1, 3, 4, etc.) may alternatively be used.

The seat 74 is pivotably suspended between the arms 72. In this example, the seat 74 includes a frame such as, for example, at least one generally horizontally disposed peripheral tube 75 having soft fabric 77 suspended therefrom. The tube 75 may be a metal tube. The base of the seat 74 may be reclined by use of a fabric cinch and release system (not shown), such as a strap release to release a pivotal back frame tube 71 downwardly away from the substantially horizontal metal tube 75, thereby lowering the fabric 77 toward (and possibly below) the plane of the horizontal metal tube 75. In a swing operating mode (see FIGS. 1-2), a child may be placed in the seat 74 in a feet forward position. To configure the seat as a jumper (see FIGS. 3-6), the seat 74 and/or the soft fabric 77 defines leg openings 79 in its base to receive the legs of a child standing within the seat 74. In some examples, the leg openings 79 may be covered or substantially covered by, for example, a soft fabric layer (not shown) when the apparatus 10 is in the swing operating mode, and exposed when the apparatus 10 is in the jumper operating mode.

The structure of the seat may vary as desired. For example, the seat may include different fabric structures, different pivotal, adjustable, and/or rigid frame member(s), and/or different component parts, such as, for example, a molded plastic shell. Furthermore, the seat may include different panel(s), door(s), (moveable or fixed) and/or aperture(s) to allow differing positions of a child in the seat.

Figure 2:
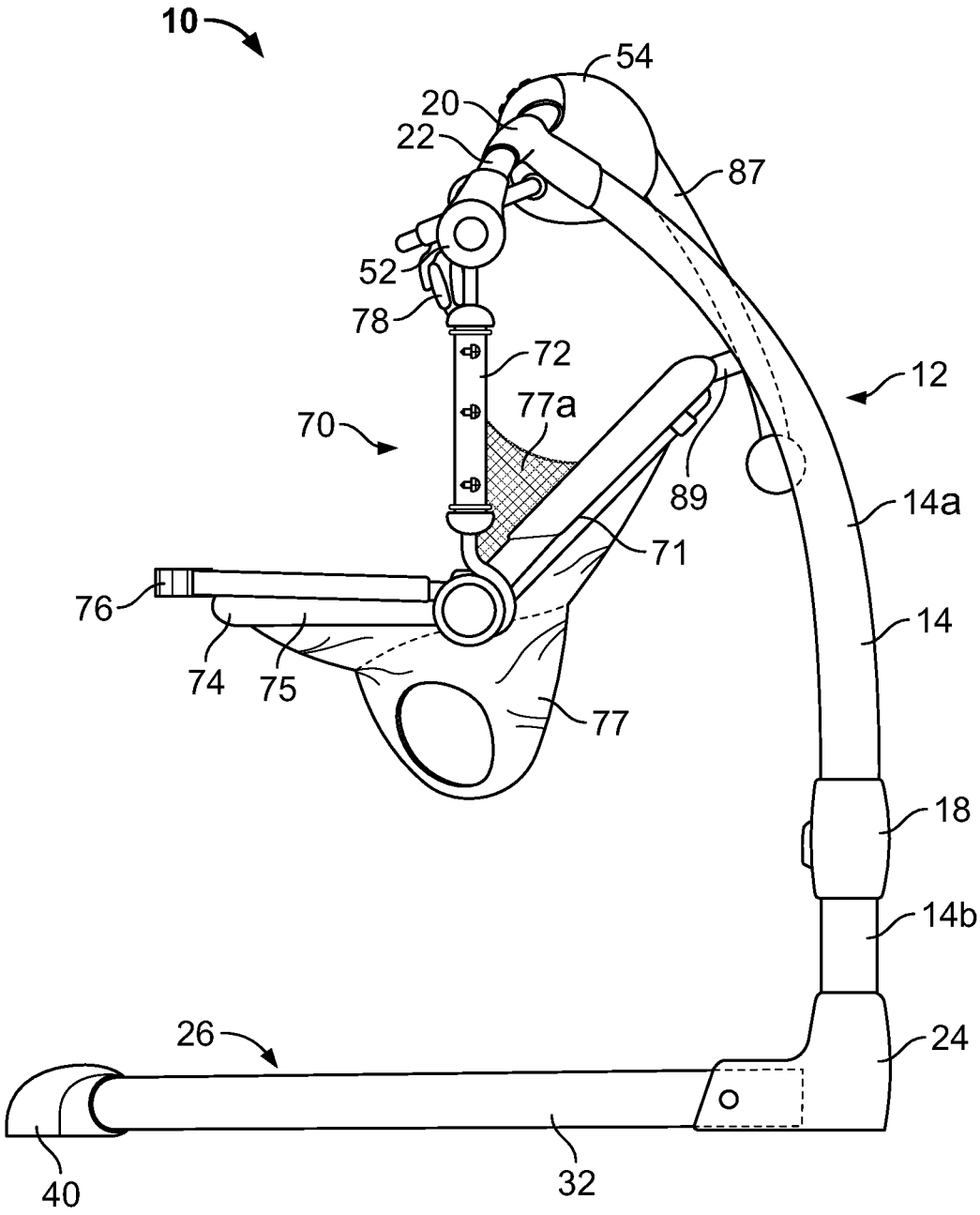
FIG. 2 is a right elevational view of the apparatus of FIG. 1.

In some examples, a fabric webbing 77*a* extends between the seat 74 and each of the swing arms 72 as illustrated in FIG. 2 to prevent a child from extending an appendage into the space between the seat 74 and the swing arm 72. Additionally, a mechanical vibrator (not shown) may be coupled to the frame, swing arms, and/or the seat to provide vibrations that can soothe or entertain a child located in the seat 74 in either the jumper or the swing mode.

Figure 4:
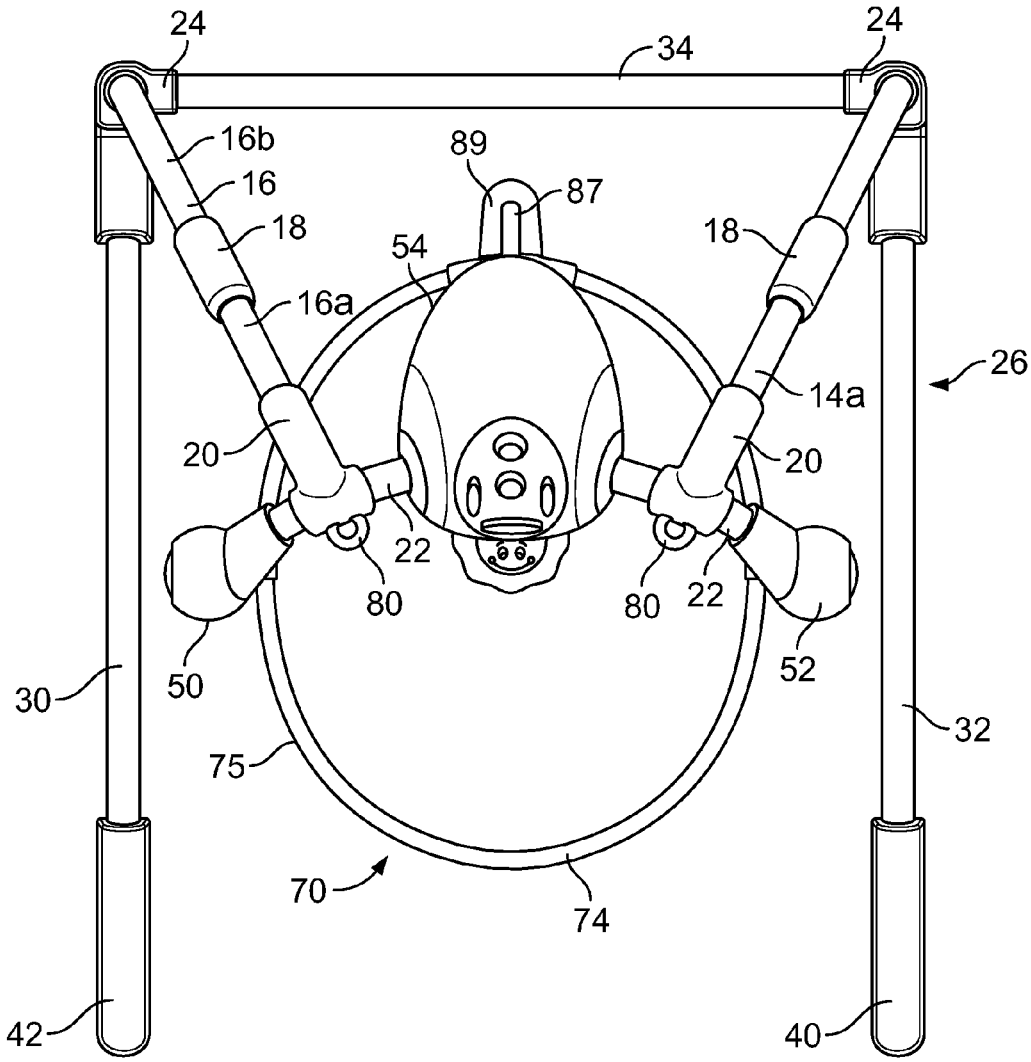
FIG. 4 is a top plan view of the apparatus of FIG. 3.

In order to support food, toys, and/or other items in front of and/or above a child seated in the seat 74, the apparatus 10 may be further provided with a tray 76, and/or a mobile 78, coupled to the cross bar 22. The mobile 78 of the illustrated example is coupled to the cross bar 22 (or other structure) via any suitable connection including, for instance, hook and loop connections, ties, and/or fasteners, which couple the mobile 78 to connection loops 80 mounted on the connector 20 (FIG. 4). In the example illustrated in FIGS. 1-2, the tray 76 may be used to support one or more toys. The tray 76 may further be removably and/or pivotally mounted to the seat 74. In the illustrated example of FIGS. 3-6, the tray 76 is removed from the seat 74 but may be reattached, removed, and/or pivoted as desired.

To facilitate conversion between the swing mode and the jumper mode, the swing arms 72 of the illustrated example are implemented by suspending means such as, for example, the illustrated convertible arms 72. As shown in FIGS. 7A-7E, each of the swing arms 72 includes two telescoping tubes. Each of the telescoping tubes includes a rigid inner tube 81 and a rigid outer tube 82. Each swing arm 72 also includes a flexible connector, such as a spring 84 coupling the inner tube 81 to the outer tube 82 so that the inner tube 81 resiliently slides and/or telescopes with respect to the outer tube 82.

Figure 7A:
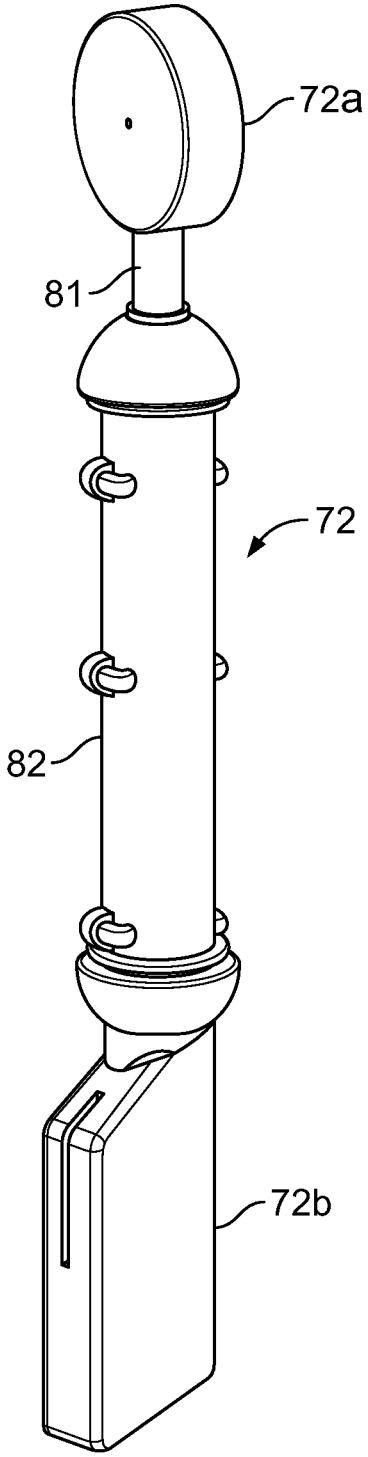
FIG. 7A is a perspective view of one of the two swing arms for use in conjunction with the apparatus of FIG. 1 or FIG. 3.
Figure 7B:
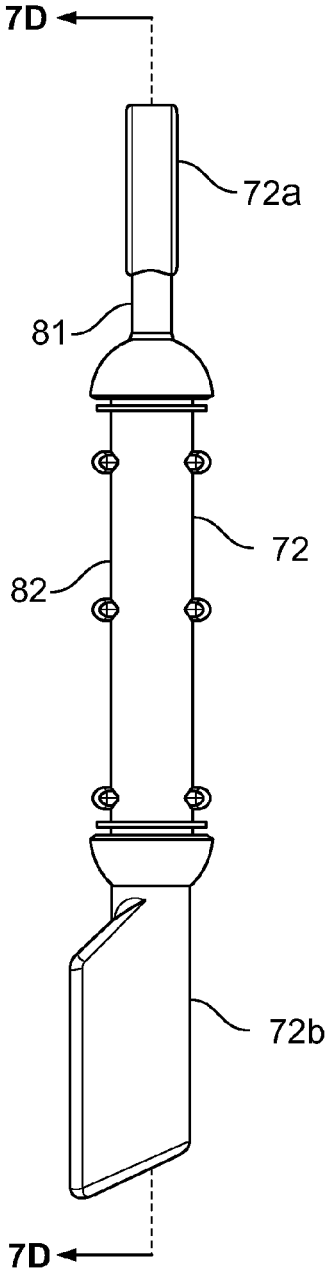
FIG. 7B is a right side view of the swing arm of FIG. 7A.
Figure 7C:
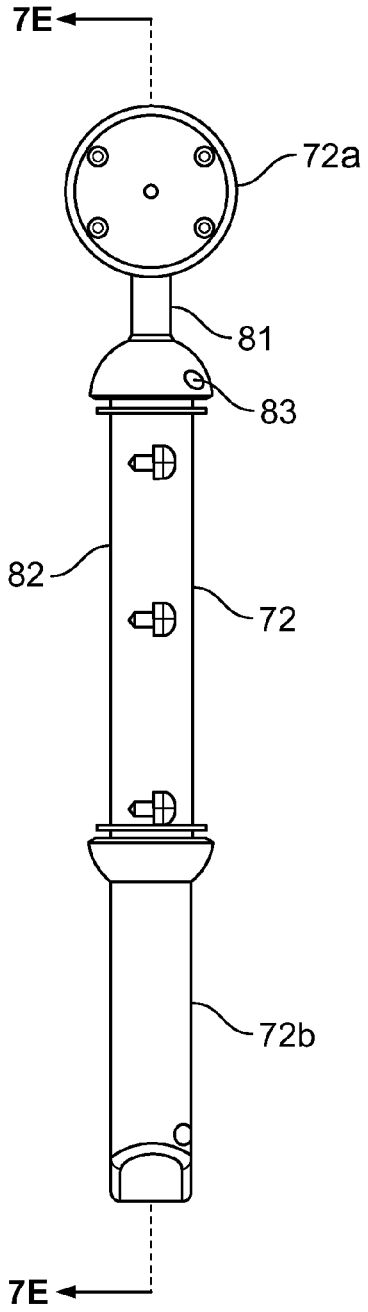
FIG. 7C is a front side view of the swing arm of FIG. 7A.
Figure 7D:
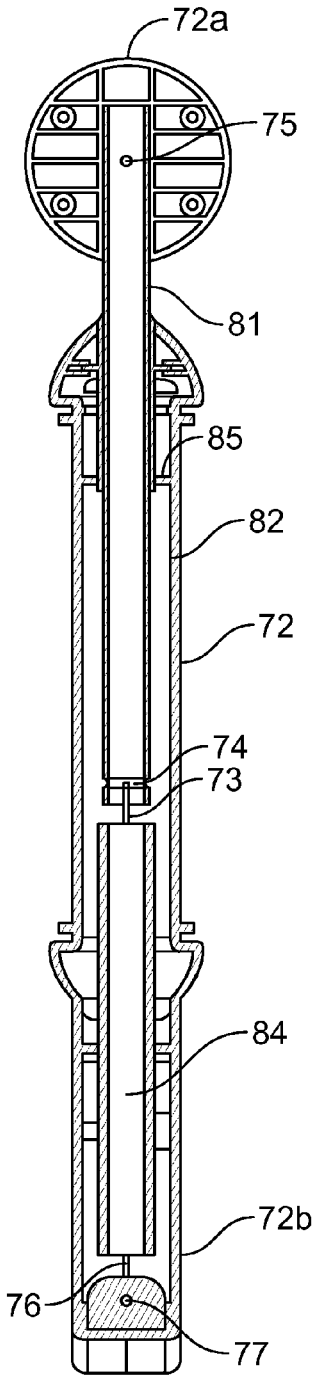
FIG. 7D is a cross sectional view taken along line 7D-7D of FIG. 7B.
Figure 7E:
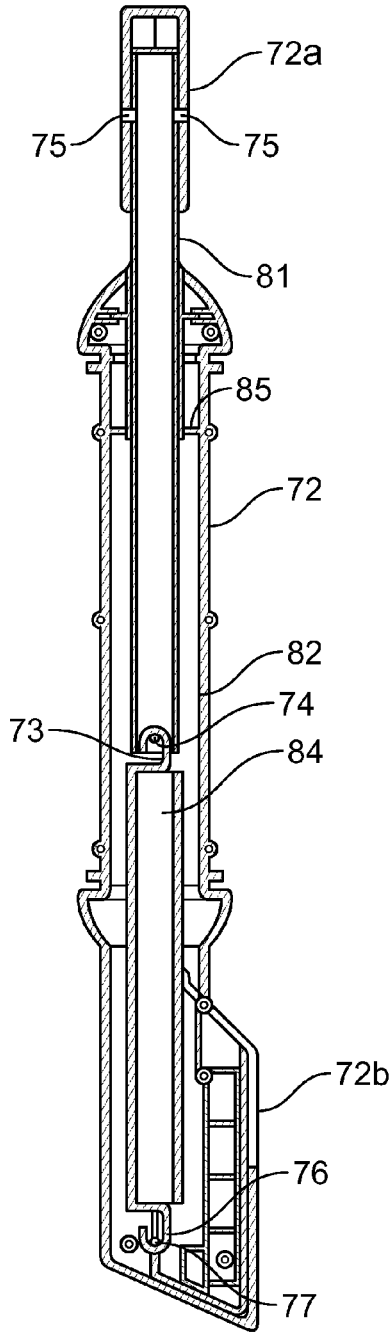
FIG. 7E is a cross sectional view taken along line 7E-7E of FIG. 7C.

In the illustrated example, the swing arm 72 includes at least one spring 84 operatively coupled at one end to the inner tube 81 by, for example, a hook 73 and pin 74 as shown in FIGS. 7D and 7E. The inner tube 81 is in turn pivotally mounted to a respective one of the housings 50, 52 at an upper end 72*a* of the arm 72. Specifically, the upper end 72*a* is journalled on a respective one of the housings 50, 52 for rotating/swinging motion by, for example, a pivot assembly (not shown) accepted by an aperture 75 formed in the upper end 72*a*. The other end of the spring 84 is operatively coupled to the end of the outer tube 82 by, for example, a hook 76 and pin 77 similar as shown. The outer tube 82 is mounted to a respective side of the seat 74 at a lower end 72*b* of the arm 72. The spring 84 of the illustrated example is at least partially covered by outer tube 82 to reduce pinch points sometimes associated with the use of a spring, and/or to enclose the spring in case of failure. Additionally, the spring 84 may be replaced and/or supplemented by any suitable flexible material and/or device, including for example, a bungee cord, elastic band, and/or other suitable material. The tubes 81, 82 are slidably coupled to telescope between an extended position and a retracted position. The rigidity of the tubes 81, 82 allows the apparatus to function as a swing, while the elasticity of the spring 84 allows an operator to impart vertical (i.e. bouncing) movement to the seat 74 of the apparatus 10. In the illustrated examples, the tubes 81, 82 of the swing arm 72 are allowed to move (i.e., telescope) relative to each other in both the swing and the jumper modes. In the illustrated example, the swing arm 72 includes position stops 85 to limit the extension of the tubes 81, 82, thereby allowing the spring 84 to extend fully under a load, yet prevent the spring 84 from over extending.

Figure 8A:
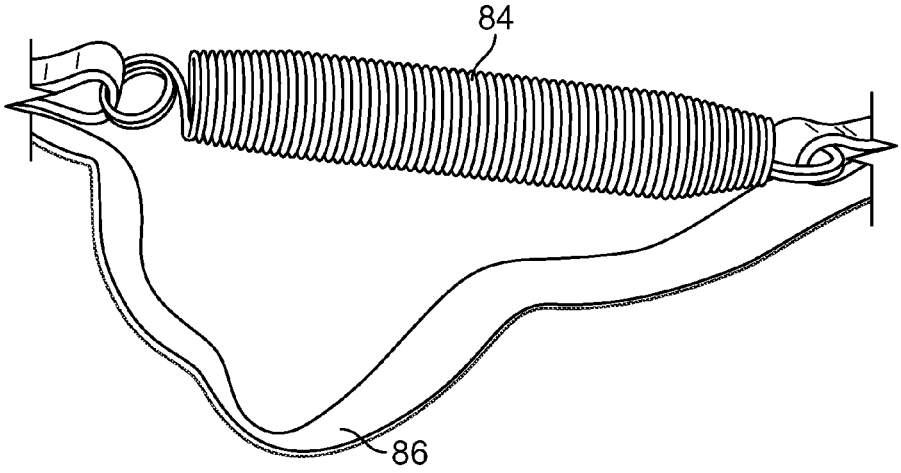
FIG. 8A is an enlarged view of the spring of FIG. 7A-7E.
Figure 8B:
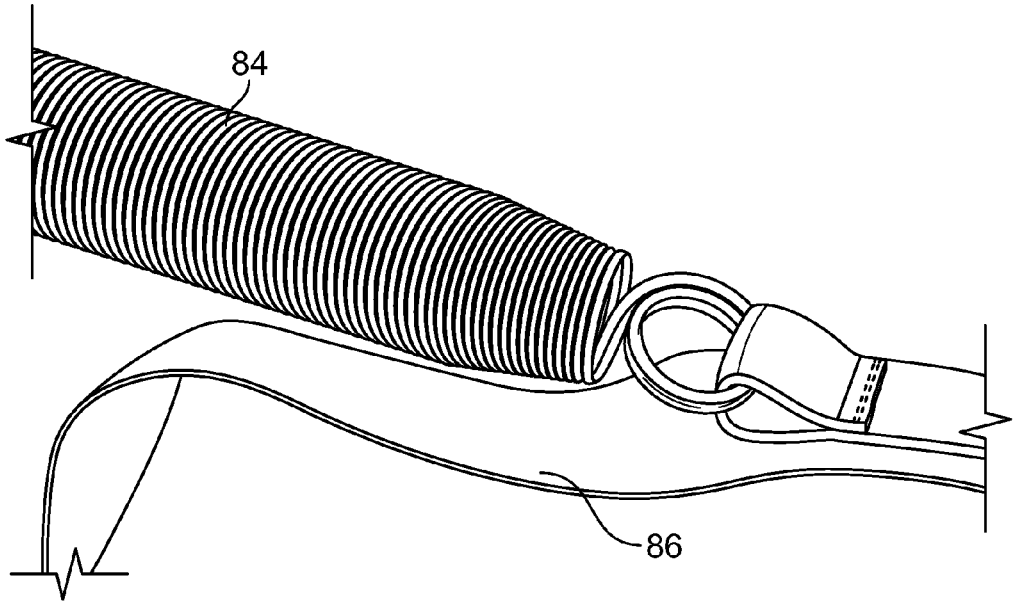
FIG. 8B is similar to FIG. 8A, but showing additional detail of the spring and tether.

Furthermore, as shown in FIG. 8, the spring 84 of the illustrated example is provided with a safety tether 86, such as webbing, to prevent the spring 84 from over extending and/or to provide a fail-safe connection between the tubes 81, 82 in the case of a spring failure.

The arm 72 may be provided with a lock (not shown) to selectively allow relative movement between the inner tube 81 and the outer tube 82. For example, the lock may include a pivotal bypass, such as a rigid arm, a friction connection, a threaded connection, and/or a pin and aperture lock arrangement, such that the lock may be shiftable between an engaged and disengaged position. When the lock is in the engaged position, it substantially prevents relative sliding movement (i.e., telescoping) between the inner tube 81 and the outer tube 82, thus providing a rigid connection between the tubes 81, 82. As a result, relative motion between the tubes 81, 82 is prevented, and the arm 72 becomes substantially rigid. In this way, telescoping movement between the tubes 80, 82 is effectively removed and, accordingly, the apparatus 10 is configured to function solely as a swing when motion is imparted to the seat 74. An apparatus with such a lockout mechanism is shown in U.S. application Ser. No. 11/885,733, entitled "Child Swing and Jumper Apparatus and Methods of Operating the Same" and hereby incorporated by reference in its entirety.

When, on the other hand, the lock is in the disengaged position, relative movement between the inner tube 81 and the outer tube 84 is permitted, and the seat 74 is, thus, suspended from the springs 84 of the arms 72. As a result, the effective length of each of the arms 72 is variable such that the seat 74 may be bounced relative to the housings 50, 52 during both swing and/or jumper modes (e.g., when the lock is disengaged) by an occupant of the seat 74.

Figure 5:
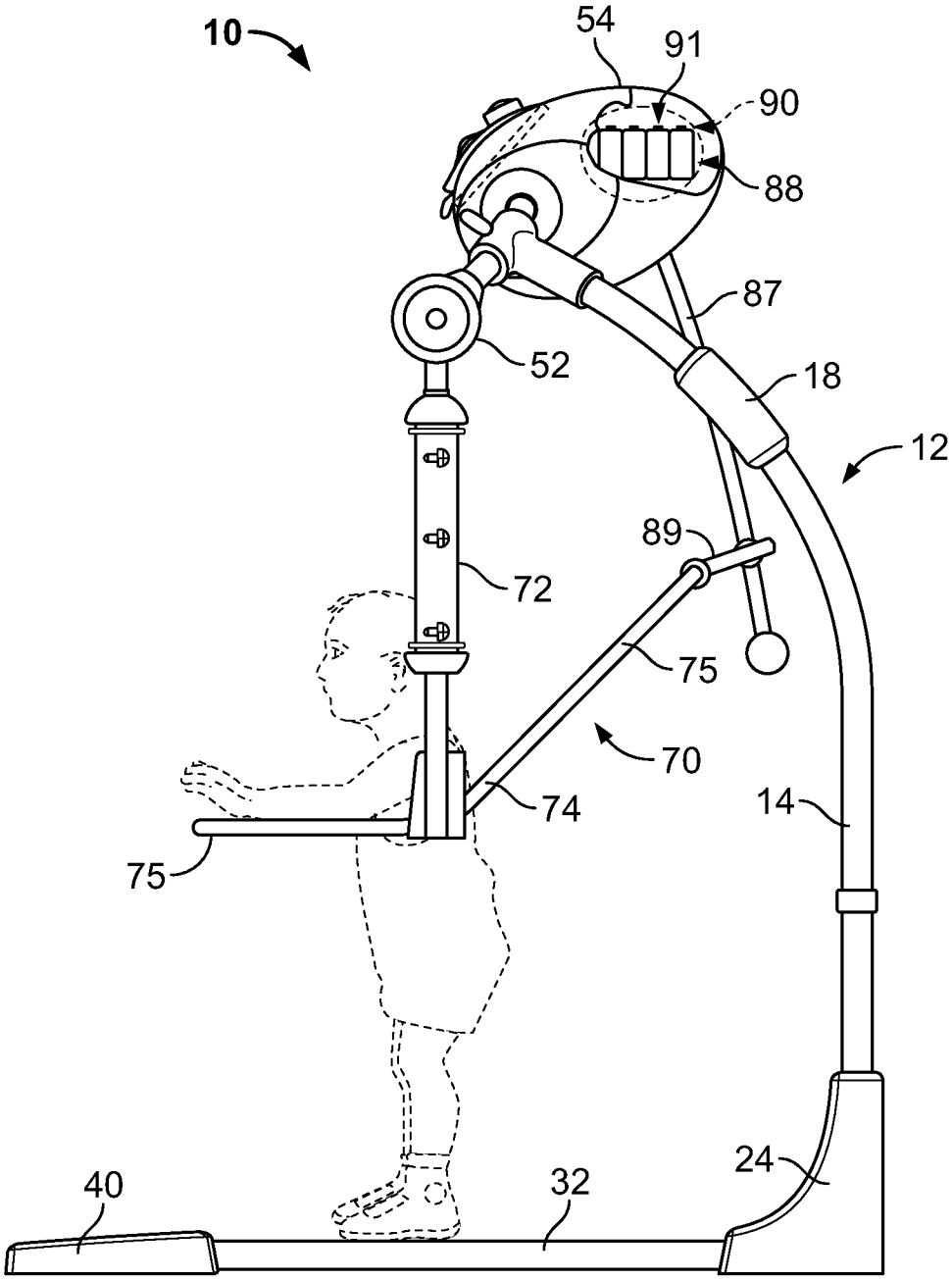
FIG. 5 is a right side view of the apparatus of FIG. 3.
Figure 6:
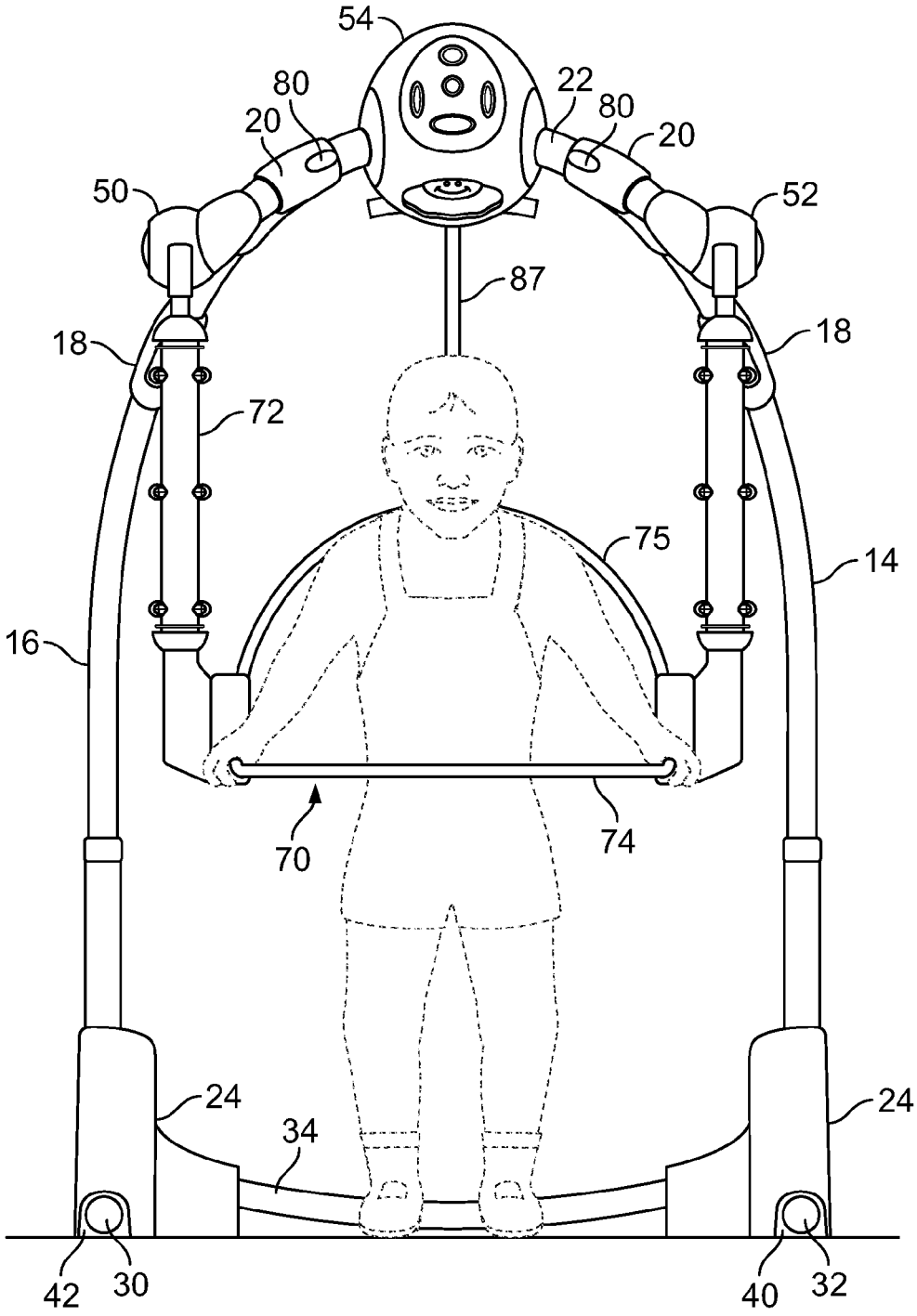
FIG. 6 is a front side view of the apparatus of FIG. 3.

In order to impart motion to the seat assembly 70, the seat 74 is coupled to the swing motor 90 through a drive arm 87. As illustrated in detail in FIGS. 9-10, in some examples, one end of the drive arm 87 is coupled to the drive motor 90, such as, for example, by extending through a channel 88 defined by the housing 54 (FIG. 5). The other end of the drive arm 87 is coupled to the seat 74. In this example, the drive arm 87 is slidably coupled to the seat 74 by a yoke or connector 89. The connector 89 is releasably attached through a friction clip 91 to the peripheral tube 75 of the seat 74 to couple the drive arm 87 to the connector 89. In the examples shown in FIG. 1 and FIG. 9, the connector 89 defines an aperture 93, which is sized to allow passage of the drive arm 87 therethrough. The drive arm 87 may therefore, slide relative to the connector 89 during operation. To assist in reducing friction between the drive arm 87 and the connector 89 while sliding relative to one another, one or more rollers 95 (see FIG. 10) or other suitable friction reducer(s) may line the aperture 93. Additionally, to prevent the end of the drive arm 87 from passing through the aperture 93 of the connector 89, the end of the example drive arm 87 includes an end cap 97 or other suitable device of a size too large to pass through the connector 89.

Figure 9:
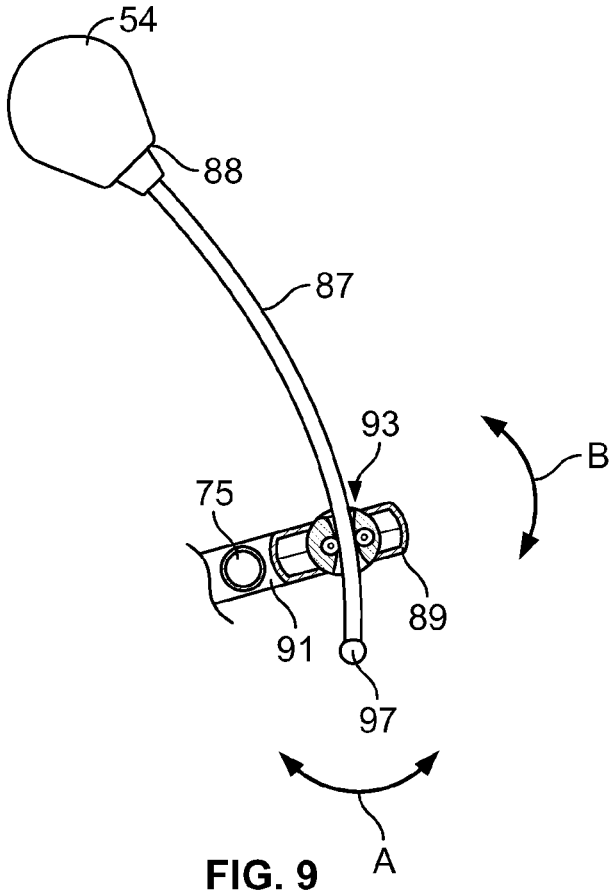
FIG. 9 is an enlarged sectional elevational view of the drive arm and seat connector for use in conjunction with the apparatus of FIG. 1 or FIG. 3.
Figure 10:
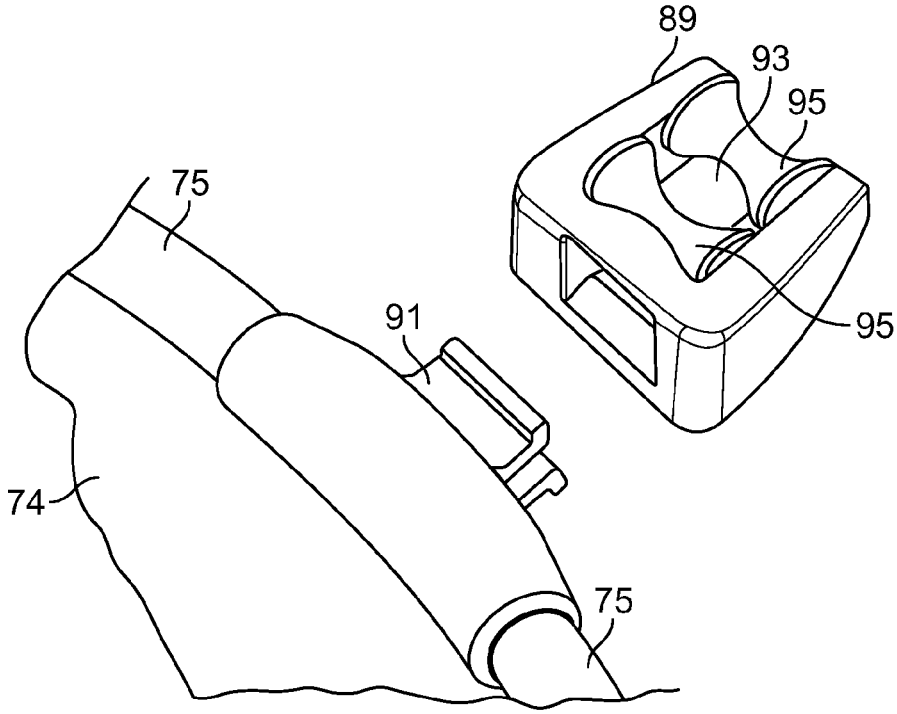
FIG. 10 is an enlarged perspective view of the connector of FIG. 9.

In operation, the drive arm 87 acts on the center of the seat 74, to impart swinging motion to the seat 74, but also allows for vertical motion of the seat 74 (i.e. bouncing) by slidably coupling the drive arm 87 to the seat 74 through the connector 89. In particular, during swing mode operation, the swing motor 90 imparts reciprocal motion to the drive arm 87 in the direction of the arrows A (FIG. 9). As a result, the drive arm 87 pulls and/or pushes the connector 89, and, thus, the seat 74, such that the seat 74 swings beneath the housings 50, 52. During operation, the connector 89 is free to slide along the length of the drive arm 87 in the direction of the arrow B (FIG. 9), thereby allowing vertical motion (i.e. bouncing) of the seat 74. By being slidably coupled to the drive arm 87 through the connector 89, vertical motion of the seat 74 will not be transferred into vertical motions of the drive arm 87 and/or the swing motor 90. As a result, the seat 74 is free to bounce in both the swing and jumper modes of the apparatus without causing damage to the drive mechanism of the apparatus.

The illustrated apparatus 10 includes a single drive arm. However, multiple drive arms, such as side mounted drive arms (e.g. swing arms), or bottom mounted arm may instead be employed. Additionally, the connector 89 may include any suitable connection for coupling the drive arm 87 to the seat 74, such as, for example, a friction fit, a four-bar-linkage, etc., and may alternatively be permanently or releasably connected to the seat 74 by clipping, snapping, or otherwise holding the connector 89 to the seat 74. Additionally, the connector 89 may be integrally or separately formed with the seat 74 and/or the drive arm 87. Still further, the drive arm 87 may be fixed in relation to the seat 74, while being slidably and/or pivotally coupled to the housing 54.

Figure 11:
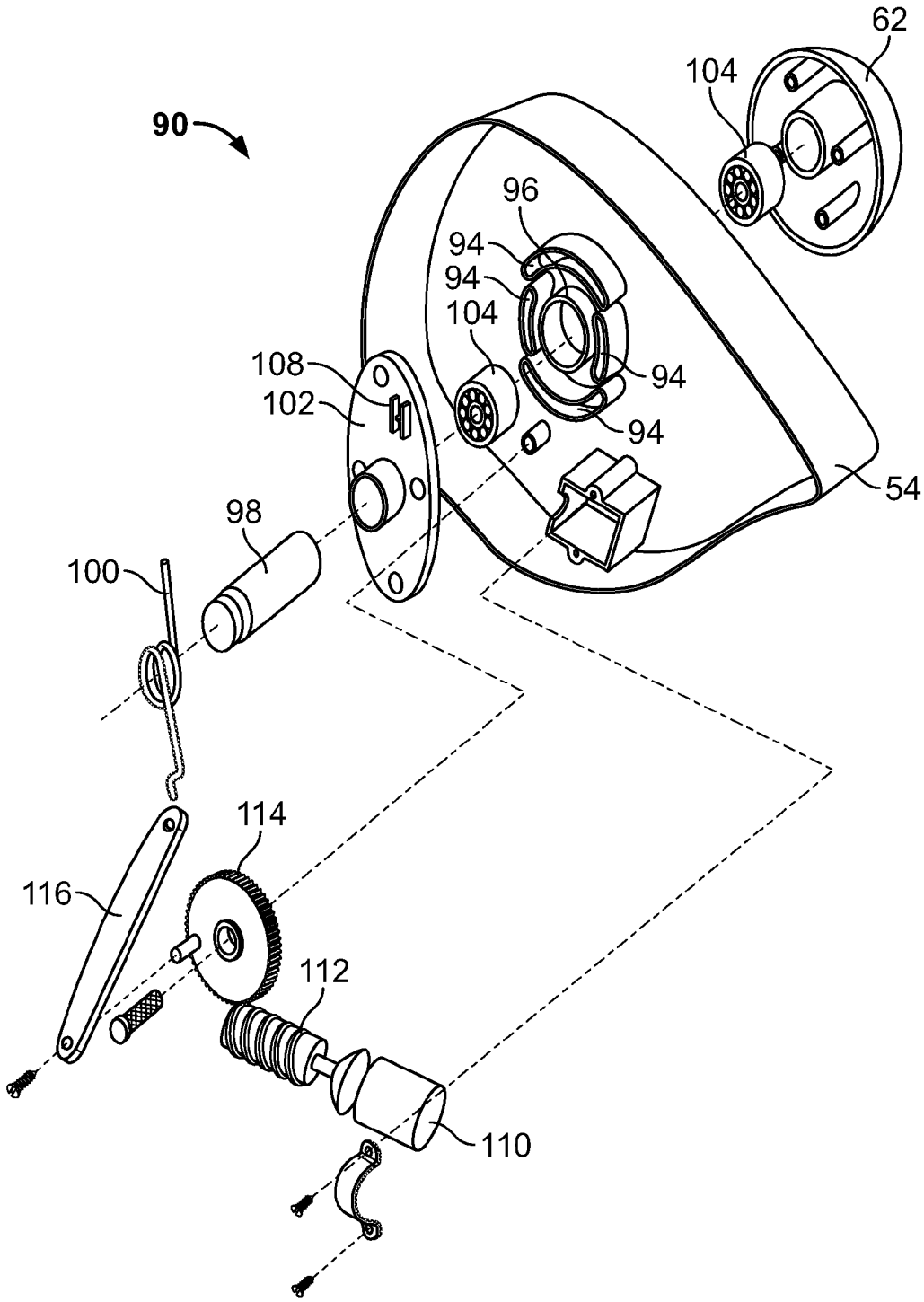
FIG. 11 is an exploded perspective view of an example swing motor for use in conjunction with the apparatus of FIG. 1 or FIG. 3.

FIG. 11 is an exploded perspective view of an example swing motor 90 that is configured to drive the seat 74 when the apparatus 10 is in the swing mode. In the illustrated example, the swing motor 90 is provided in the housing 54. The housing 54 defines a plurality of preformed channels 94 and an axle opening 96 holding a fixed (non-rotating) axle 98. Pivotally mounted to the axle 98 is a drive spring 100, a drive plate 102, a pair of pivot bearings 104, and a hub 62. The drive spring 100 may be coupled to the drive plate 102 via a channel 108, formed, in this example on the surface of the drive plate 102. There may be lost motion between the spring 100 and the channel 108. The drive plate 102 includes a plurality of projections (not shown) to extend at least partially into the channels 94, to limit and/or guide the motion of the drive plate 102 and mate with projections in the hub 62.

To move the drive spring 100, the drive plate 102, and the swing arm 106, the drive spring is coupled to a motor 110. In the illustrated example, the motor 110 is coupled to a worm gear 112 to rotatably drive the same. The worm gear 112, in turn, is operatively coupled to a planetary gear 114 rotatably mounted to the housing 54. A link arm 116 includes a first end pivotally mounted to a carrier on the periphery of the planetary gear 114 and a second end coupled to the drive spring 100 for pivoting the drive spring 100 about the axle 98. There may be lost motion between the link 116 and the spring 100. The rotation of the motor 110 translates into a generally arcuate swing motion of the hub 62. The hub 62 is coupled to the drive arm 87. As a result, the motor 110 drives the drive arm 87 into reciprocating motion via the drive chain explained above.

The swing motor 90 may include a plurality of user operable buttons 120 that may be used to set a different operating conditions such as, for example, the speed or period of the swinging motion, music and/or lighting associated with the apparatus 10, and/or any other operating parameter.

Figure 12:
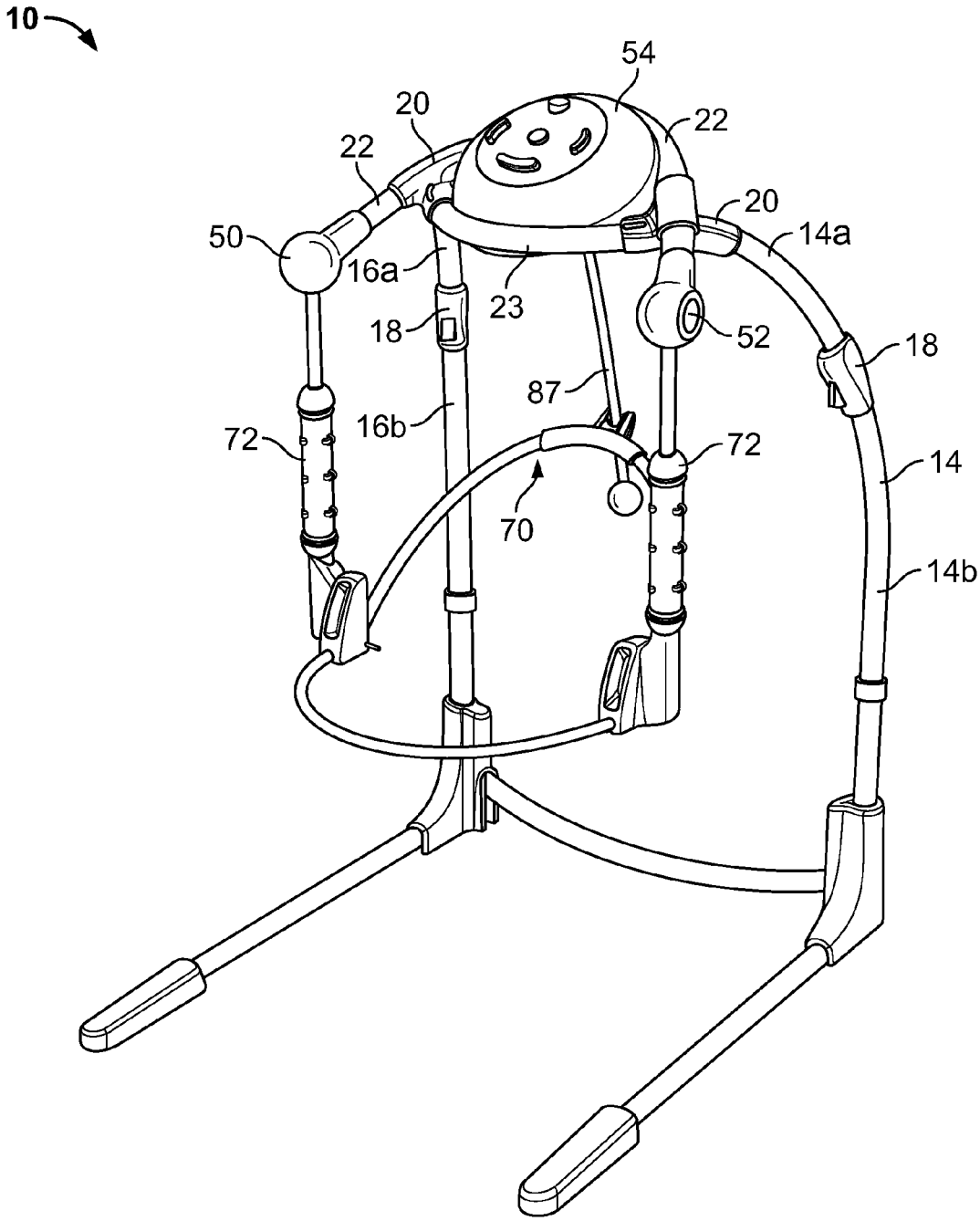
FIG. 12 is a perspective view of another example child swing and jumper apparatus constructed in accordance with the teachings of the present disclosure.

FIG. 12 is a perspective view of another alternative example child swing and jumper apparatus 10 similar to FIG. 3, but with a different frame 12 and housing 54 construction. In particular, in this example, the upper end of each of the frame legs 14, 16 is fastened to one end of a respective connector 20, while the connectors 20 support the first cross bar 22, as well as a second cross bar 23. The first cross bar 22 supports the pivot housings 50, 52 at each end of the first cross bar 22, while both the first cross bar 22 and the second cross bar 23 cooperate to support the motor housing 54 generally centrally located along the cross bars 22, 23.

Figure 13A:
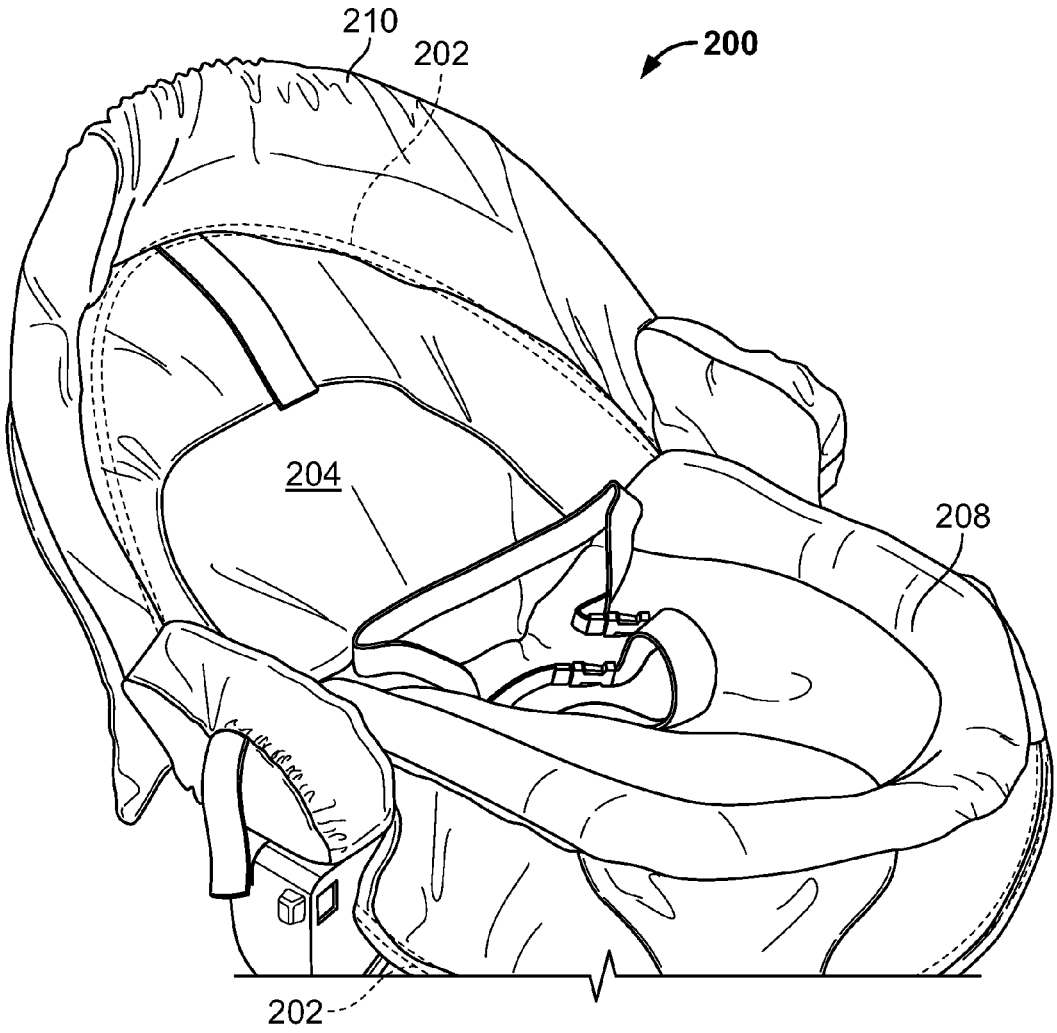
FIGS. 13A-13B are perspective views of an example seat that may be utilized in the example child swing and jumper apparatus.
Figure 13B:
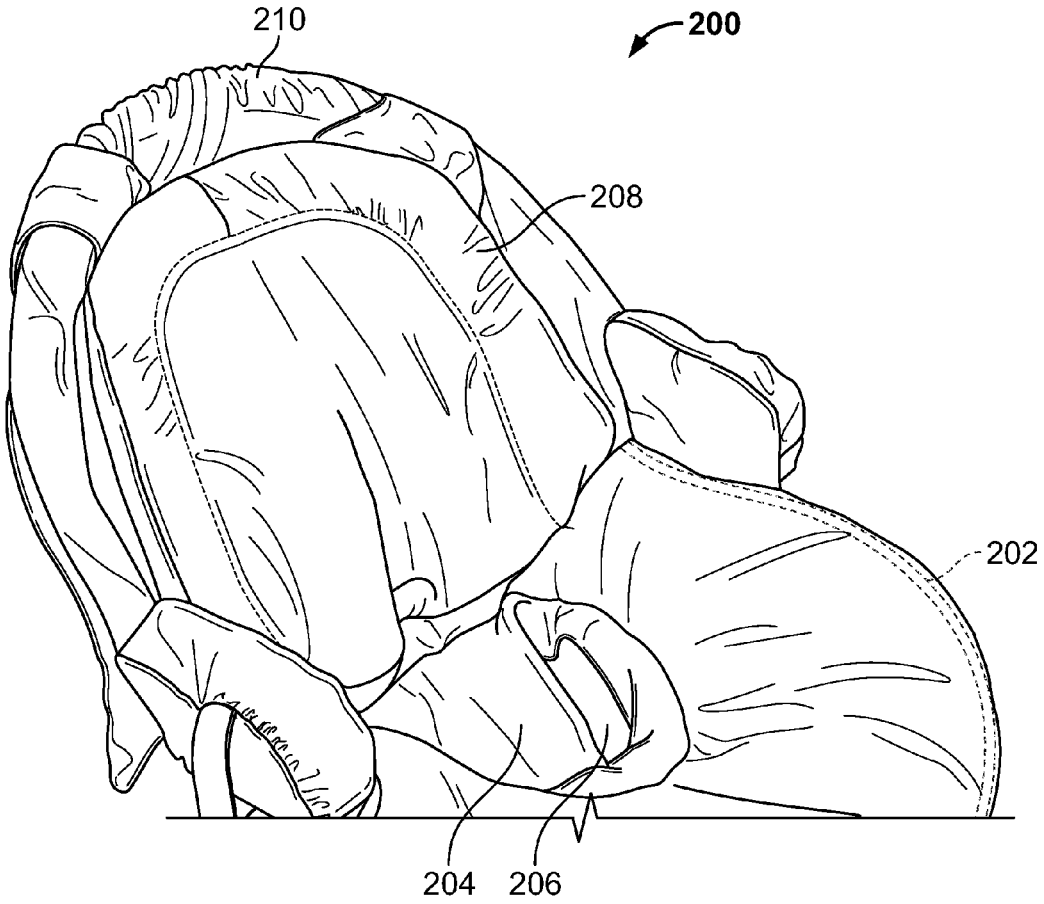

FIGS. 13A and 13B illustrate an example of a convertible swing/jumper seat 200 that may be used in conjunction with the apparatus 10. In this example, the seat 200 includes a frame such as, for example, at least one peripheral metal tube 202 having soft fabric 204 suspended between the peripheral tubes 202. In a swing operating mode (see FIG. 13A), a child may be placed in the seat 200 in a feet forward position. To configure the seat as a jumper (see FIG. 13B), the seat 200 and/or the soft fabric 204 defines leg openings 206 in its base to receive the legs of a child standing within the seat 200. A sculpted and/or contoured insert, such as for example, a plastic insert, may be inserted inside the fabric 204 of the seat 200 to assist in supporting the child and maintaining a more upright position while in the jumper mode. In this example, the leg openings 206 are covered or substantially covered by a soft fabric layer 208. The forward edge and/or other portion of the soft fabric layer 208 may be releasably attached to the seat pad and/or the seat back via elastic, hook and loop fastener, and/or any other suitable connector to secure the layer 208 in the position of FIG. 13A and/or in the raised position of FIG. 13B.

In the illustrated example, an adjustable canopy 210 is coupled to the seat 200 to provide shade to an infant located in the seat 200 in either the jumper or the swing mode. Additionally, a mechanical vibrator (not shown), or other desired device may be coupled to the apparatus 10 and/or the seat frame 202 to provide movement and/or vibrations that can soothe, or entertain an infant located in the seat 200 in either the jumper or the swing mode.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

We claim:

1. A method of constructing a child entertainment apparatus, the method comprising:

suspending a seat from a frame via a first arm and a second arm; and slidably coupling the seat to a third arm supported by the frame to enable the seat to slide along the second arm when the seat swings.

2. A method as defined in claim 1, wherein suspending the seat comprises journaling the seat to the frame via the first arm and the second arm, the first arm and the second arm each having a support suspended from the frame.

3. A method as defined in claim 2, further comprising telescopically coupling a first portion of the support and a second portion of the support.

4. A method as defined in claim 3, further comprising connecting the first portion of the support toward the second portion of the support via a flexible connector.

5. A method as defined in claim 2, further comprising coupling a first portion of the support to the frame and coupling a second portion of the support to the seat.

6. A method of claim 3, further comprising locking the first portion of the support relative to the second portion of the support to prevent movement of the first portion of the support relative to the second portion of the support.

7. A method of claim 1, further comprising operatively coupling a first end of the third arm to a motor and slidably coupling a second end of the second arm to the seat.

8. A method of claim 7, further comprising coupling the second end of the third arm to the seat via a connector attached at an approximate midpoint of an upper end of a seat back portion.

9. A method of fabricating a child entertainment apparatus comprising:

suspending a seat from a frame to enable swinging motion of the seat relative to the frame when the child entertainment is in a swing mode of operation and to enable bouncing motion of the seat relative to the frame when the child entertainment is in a jumping mode of operation;

operatively coupling a first end of a drive arm to a drive mechanism being supported by the frame; and slidably coupling a second end of the drive arm to the seat via a connector to enable the drive arm to slide relative to the connector when the child apparatus is in the swing mode or the jumping mode.

10. A method as defined in claim 9, wherein suspending the seat from the frame comprises suspending the seat via a support that is to enable vertical motion of the seat relative to the frame when the child entertainment apparatus is in the jumping mode.

11. A method as defined in claim 10, further comprising telescopically coupling a first portion of the support and a second portion of the support to enable the vertical motion of the seat relative to the frame.

12. A method as defined in claim 10, wherein suspending the seat to the frame comprises journaling a first portion of the support to the frame and coupling a second portion of the support to the seat.

13. A method as defined in claim 9, wherein reciprocating the drive arm via the drive mechanism is to impart the swinging motion to the seat.

14. A method as defined in claim 9, further comprising configuring the seat in a feet forward position when the seat is in the swing mode and configuring the seat in a feet downward position when the seat is in the jumping mode.

15. A method of manufacturing a child entertainment apparatus comprising:

coupling a seat to a frame via a support to enable movement of the seat in a first direction relative to the frame when the child entertainment apparatus is in a first mode of operation, and to enable movement of the seat in a second direction relative to the frame when the child entertainment apparatus is in a second mode of operation, the second direction being substantially perpendicular to the first direction;

slidably coupling a drive arm to the seat via a connector coupled to the seat; and causing the seat to slide relative to the drive arm via the connector when the child entertainment apparatus is in the first mode and when the child entertainment apparatus is in the second mode.

16. A method as defined in claim 15, further comprising telescopically coupling a first member of the support to a second member of the support to enable the first member to move relative to the second member in the second direction when the seat is moving in the second direction.

17. A method as defined in claim 16, further comprising pivotally coupling a first end of the first member to the frame and fixedly coupling a first end of the second member to the seat.

18. A method as defined in claim 17, further comprising biasing the first member of the support toward the second member of the support.

19. A method of manufacturing a child entertainment apparatus comprising:

coupling a seat to a frame via a support to enable movement of the seat in a first direction relative to the frame when the child entertainment apparatus is in a first mode of operation, and to enable movement of the seat in a second direction relative to the frame when the child entertainment apparatus is in a second mode of operation, the second direction being substantially perpendicular to the first direction; and slidably coupling an end of a drive arm to the seat via a connector coupled to the seat to enable the seat to slide relative to the drive arm when the child entertainment apparatus is in the first mode and when the child entertainment apparatus is in the second mode, the connector including rollers forming an aperture to slidably receive the end of the drive arm.

20. A method of manufacturing a child entertainment apparatus comprising:

coupling a seat to a frame via a support to enable movement of the seat in a first direction relative to the frame when the child entertainment apparatus is in a first mode of operation, and to enable movement of the seat in a second direction relative to the frame when the child entertainment apparatus is in a second mode of operation, the second direction being substantially perpendicular to the first direction; and slidably coupling an end of a drive arm to the seat via a connector coupled to the seat to enable the seat to slide relative to the drive arm when the child entertainment apparatus is in the first mode and when the child entertainment apparatus is in the second mode, the connector including a mechanism to reduce friction between the drive arm and the connector.

* * * * *

UNITED STATES PATENT AND TRADEMARK OFFICE

CERTIFICATE OF CORRECTION

PATENT NO. : 8,439,765 B2
APPLICATION NO. : 13/284118
DATED : May 14, 2013
INVENTOR(S) : Barron et al.

It is certified that error appears in the above-identified patent and that said Letters Patent is hereby corrected as shown below:

In the Claims

Column 7, line 59 (claim 1), delete “second” and insert --third--.
Column 8, line 13 (claim 7), delete “second arm” and insert --third arm--.

Signed and Sealed this
Twenty-fifth Day of June, 2013

Teresa Stanek Rea
*Acting Director of the United States Patent and Trademark Office*